US006318977B1

(12) United States Patent
Kopko

(10) Patent No.: US 6,318,977 B1
(45) Date of Patent: Nov. 20, 2001

(54) RECIPROCATING COMPRESSOR WITH AUXILIARY PORT

(75) Inventor: William Leslie Kopko, Springfield, VA (US)

(73) Assignee: WorkSmart Energy Enterprises, Inc., Washington, DC (US)

( * ) Notice: Subject to any disclaimer, the term of this patent is extended or adjusted under 35 U.S.C. 154(b) by 0 days.

(21) Appl. No.: 09/166,161

(22) Filed: Oct. 5, 1998

Related U.S. Application Data

(60) Provisional application No. 60/060,968, filed on Oct. 6, 1997.

(51) Int. Cl.[7] ..... F04B 7/04; F04B 17/04; F04B 23/00; F04B 49/00; F25B 41/00

(52) U.S. Cl. ..... 417/493; 417/495; 417/505; 417/507; 417/503; 417/417; 417/545; 417/440; 417/307; 62/196.4

(58) Field of Search ..... 417/493, 495, 417/445, 442, 443, 444, 505, 507, 503, 417, 571, 545, 552, 440, 307; 62/196.4

(56) References Cited

U.S. PATENT DOCUMENTS

| | | | | |
|---|---|---|---|---|
| 877,492 | * | 1/1908 | Doelling | 417/285 |
| 963,788 | * | 7/1910 | Merrill | 417/363 |
| 1,036,934 | * | 8/1912 | Toaz | 417/440 |
| 1,234,684 | * | 7/1917 | Niebling | 417/491 |
| 1,307,061 | * | 6/1919 | Olsen | 417/435 |
| 1,321,923 | * | 11/1919 | Knox | 92/59 |
| 1,481,358 | * | 1/1924 | Dwyer | 417/440 |
| 1,614,851 | * | 1/1927 | Prestage | 417/509 |
| 2,006,584 | * | 7/1935 | De Puy | 230/22 |
| 2,172,751 | * | 9/1939 | Heinrich | 230/31 |
| 2,236,853 | * | 4/1941 | Herzmark | 230/135 |
| 2,334,939 | * | 11/1943 | Larson | 230/172 |
| 2,772,831 | * | 1/1956 | Cotter | 230/211 |
| 3,759,057 | * | 9/1973 | English et al. | 62/196 |
| 4,297,083 | * | 10/1981 | Von Petery | 417/53 |
| 4,389,849 | * | 6/1983 | Gasser et al. | 310/15 |
| 5,342,176 | * | 8/1994 | Redlich | 417/212 |
| 5,537,820 | * | 7/1996 | Beale et al. | 60/517 |

* cited by examiner

*Primary Examiner*—Timothy S. Thorpe
*Assistant Examiner*—Timothy P. Solak

(57) ABSTRACT

A reciprocating compressor that includes an auxiliary port 38 in series with a check valve 40 to move fluid at an intermediate pressure that is between the main suction and discharge pressures. Piston 31 normally covers the auxiliary port during a portion of its stroke. In one embodiment the check valve 40 is oriented so that fluid flows into the compressor. The piston 31 uncovers the auxiliary port 38 during the early part of the down stroke to allow fluid in through the port. As the piston 31 continues to move down it covers the auxiliary port, which drops pressure in chamber 37 to allow fluid to enter through a main suction valve 34. In other embodiments the orientation of the check valve is reversed and auxiliary port acts as an auxiliary discharge port. Multiple auxiliary ports may be used in a single cylinder to achieve multiple suction and/or discharge pressures. The preferred driving mechanism for the piston is a linear motor 32 or other variable-stroke device, which can control the portion of flow through the auxiliary port by adjusting piston position.

13 Claims, 4 Drawing Sheets

RECIPROCATING COMPRESSOR WITH AUXILIARY PORT

The applicant claims benefit of U.S. provisional application No. 60/060,968 filed on Oct. 6, 1997.

BACKGROUND OF THE INVENTION

1. Field of Invention

This invention relates to a new reciprocating compressor design. Specifically it relates to the use of auxiliary ports to handle additional suction and discharge pressures in a reciprocating compressor.

2. Description of the Prior Art

Current reciprocating compressors and linear compressors have a single suction valve and a single discharge valve. The piston draws gas through the suction valve during the down stroke. At the bottom of the stroke, the suction valve closes and allows the piston to compress the gas during the up stroke. Once the pressure inside the cylinder exceeds that of the discharge gas, the discharge valve opens and allows the gas to discharge from the cylinder.

A problem with this arrangement is that the compressor can only handle a single suction and a single discharge pressure. Many refrigeration and heat-pump applications need more that one suction or discharge pressure, which means that the lowest evaporating condition and the highest condensing condition set the pressures to the compressor. This situation leads to an inefficient system that sacrifices both efficiency and capacity. The other alternative requires the use of multiple compressors and staged arrangements that add to complexity and cost.

Gardner Voorhees in his 1905 patent (793,864) entitled "Multiple effect compressor," describes a valving arrangement that can improve capacity- and efficiency of reciprocating compressors in systems with multiple evaporating pressures. The basic idea is to add a port to the cylinder wall that can introduce gas at a higher suction pressure. The piston uncovers the port at the bottom of its stroke, which allows the higher-pressure gas into the cylinder. The higher pressure closes the main suction valve. Multiple auxiliary ports can be added to give additional suction pressures.

This multiple-effect system was commonly used in large ammonia compressors in the 1920's. These compressors usually ran at speeds of 100 rpm or slower, which is extremely slow by today's standards. Typical applications were large ice plants, which used a second, higher-pressure evaporator to precool incoming water.

While the multiple-effect compressor systems gave significant efficiency and capacity advantages, changes in compressor design effectively eliminated their widespread use. The introduction of modern high-speed compressors in the 1930's and 40's greatly reduced physical size of compressors, which also reduced the value of the capacity advantage associated with multiple-effect systems. These higher speeds also greatly increased the potential wear problems associated with piston rings moving over an auxiliary port. Lower energy costs reduced the value of the efficiency advantages. These considerations have made the multiple-effect compressor simply a historical curiosity.

U.S. Pat. No. 4,332,144 makes use of similar ideas. This system uses a heat exchanger that evaporates refrigerant at an intermediate pressure to subcool refrigerant liquid before it reaches the main evaporator. This arrangement improves the efficiency and capacity of the system, but it does not describe a particular compressor design for accommodating the higher-pressure port.

The objective of the present invention is to improve upon the multiple-effect compressor. These improvements should eliminate the previous problems with piston rings sliding over an auxiliary port. They should also provide additional options that further improve the efficiency and flexibility of the compressor and the refrigeration system.

SUMMARY OF THE INVENTION

The invention uses auxiliary porting and valving arrangements in a reciprocating compressor to give major improvements in system efficiency and capacity. The reciprocating compressor is preferably a linear compressor or other compressor with variable stroke capability. These porting advances are especially suited to linear compressors because the linear motor eliminates side loads which allows for the elimination of piston rings and thus eliminates potential piston-ring wear problems. In addition the linear compressor typically uses a piston length that is longer than the stroke, which allows for better use of auxiliary ports. The linear compressor gives a large degree of freedom in piston position and stroke, which allows for much better control over auxiliary suction and discharge ports. Finally the linear compressor has extremely low friction loss in the compressor, which greatly improves efficiency of the system compared conventional crank machines.

DESCRIPTION OF THE PREFERRED EMBODIMENTS

Figure 1:
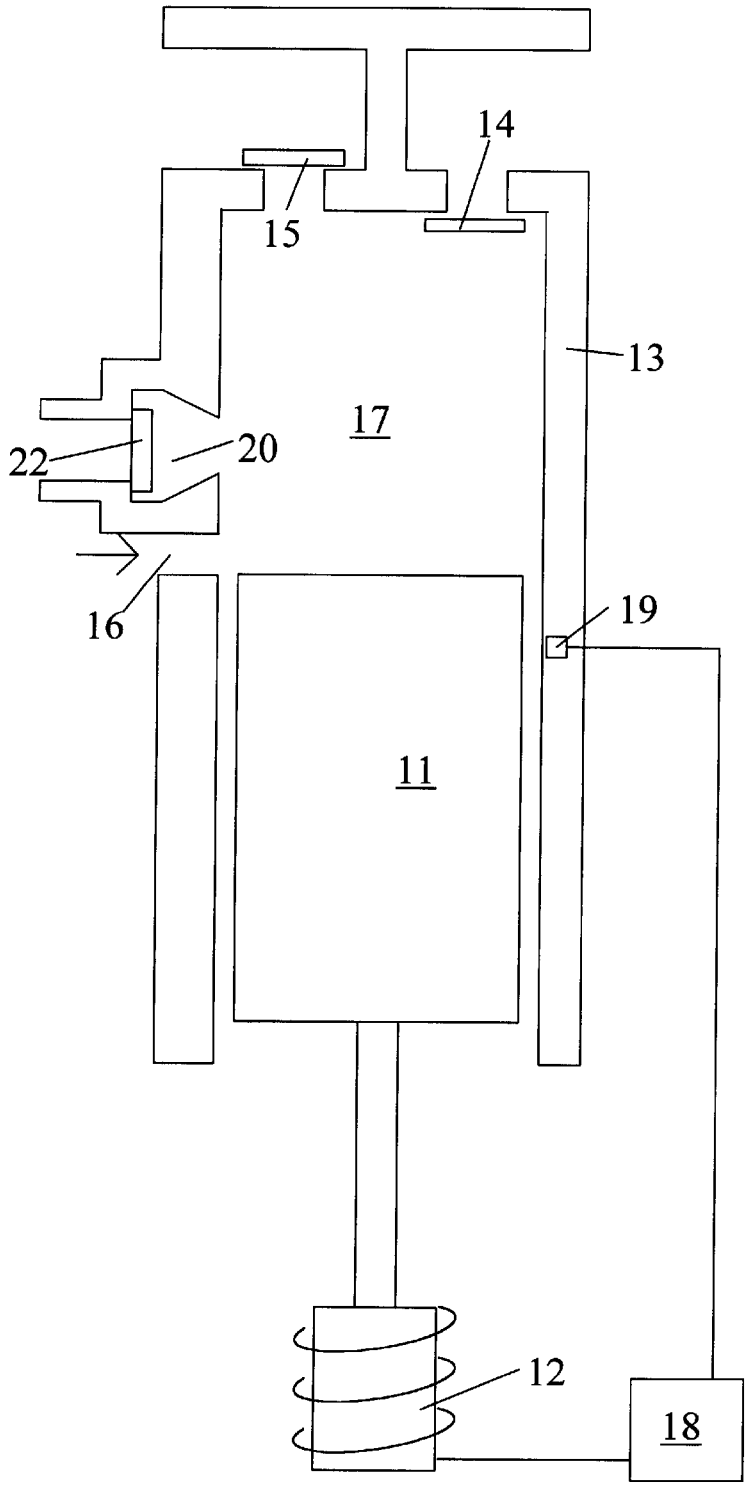
FIG. 1 shows one preferred embodiment that uses an auxiliary port in the sidewall to raise the cylinder pressure at the end of the suction stroke.

FIG. 1 shows one basic arrangement. Linear motor 12 drives piston 11 which reciprocates in a cylinder 13. Main suction valve 14 allows low-pressure suction gas into chamber 17. The main suction valve serves as a means for admitting fluid into the chamber. Discharge valve 15 serves as means for discharging fluid from the cylinder when the chamber pressure exceeds the discharge pressure. A first auxiliary port 16 admits gas at an intermediate pressure between the suction and discharge pressures. This auxiliary port acts an auxiliary suction port. The gas enters the cylinder at the end of the intake stroke when the piston uncovers the auxiliary port.

An optional second auxiliary port 20 with a check valve 22 is located in the sidewall above the first auxiliary port. The optional second auxiliary port 20 admits gas at an intermediate pressure that is between that of the fist auxiliary port 16 and the pressure supplied to the main suction valve 14. A controller 18 is connected to the linear motor 12 and a piston-position sensor 19. The controller adjusts the voltage supplied to the linear motor to control piston position.

An important improvement from the prior art is the use of the linear motor in combination with the auxiliary ports. The linear motor eliminates practically all the side forces on the piston, which eliminates the need for piston rings. Gas bearings or liquid bearings can support the piston. The piston would normally resonate on a spring at fixed frequency. This resonance improves efficiency and reduces the size of the motor. A linear motor allows free-piston operation that is not constrained by a crank mechanism. Simply varying the voltage can adjust the stroke of the piston. Other controls to the spring or motor can also adjust the mean location of the piston in the cylinder. (For information on prior art related to linear motors used in free-piston machines see U.S. Pat. Nos. 5,537,820; 5,525,845; 5,496,153; 5,342,176; and 4,602,174.)

While a linear motor is the preferred piston drive system, any variable stroke device, such as a wobble-plate mechanism or free-piston engine, are also possible. These alternative drive systems would achieve the similar control advantages but may have lower reliability and efficiency than linear-motor designs.

In the arrangement in FIG. 1, the piston 11 uncovers the auxiliary port 16, which admits gas at a pressure that is between the main suction and discharge pressure. The higher-pressure gas causes the main suction valve to close. While one auxiliary port is shown in this drawing it may be desirable to have multiple ports spread around the circumference of the cylinder to better balance the side loads on the piston and increase flow area.

Figure 2:
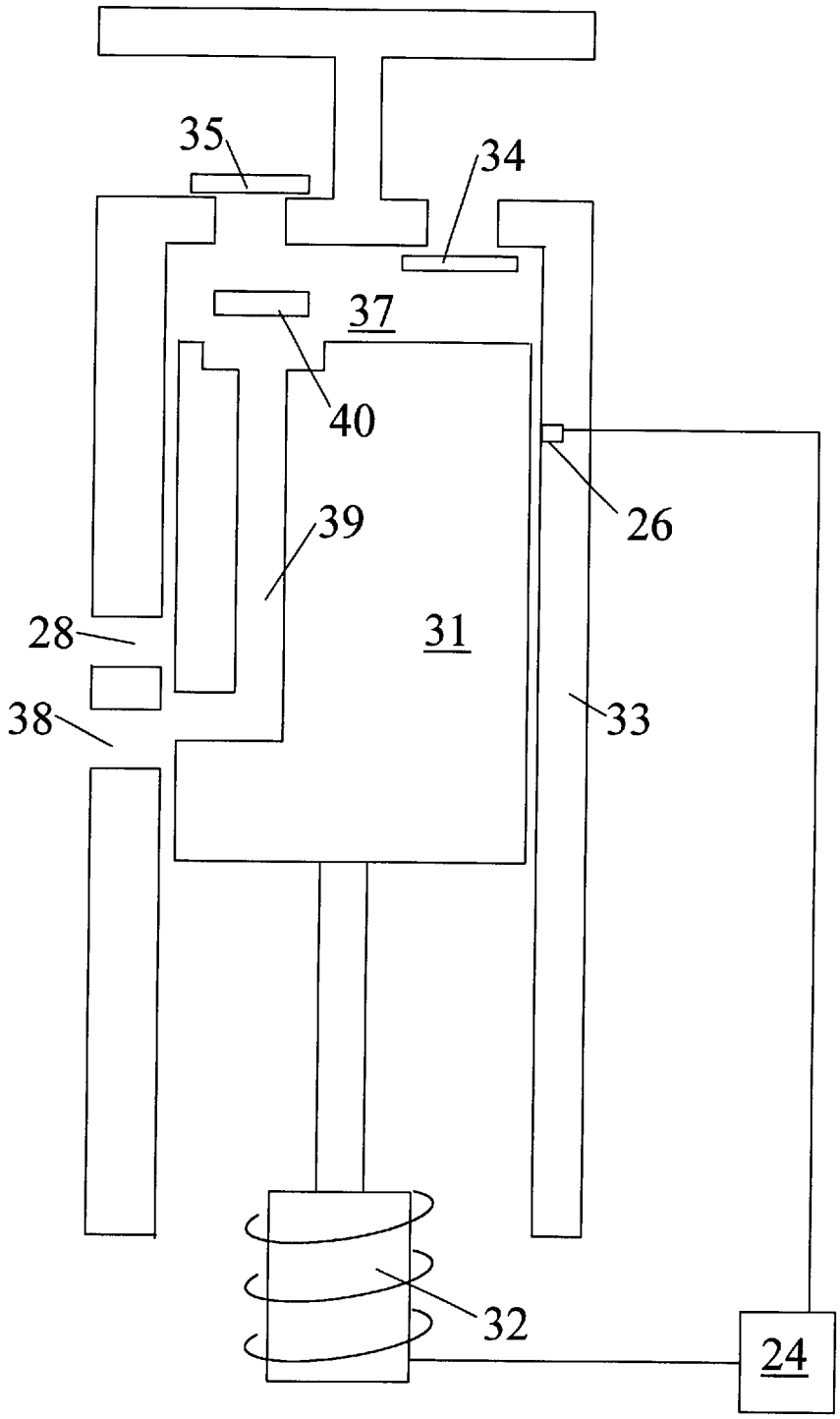
FIG. 2 shows another preferred embodiment that uses an auxiliary suction valve in the piston and an auxiliary port to introduce higher-pressure suction gas at the beginning of the suction stroke.

FIG. 2 shows a second compressor configuration that includes a valve in the piston. The difference is that auxiliary port 38 is an axial groove in the cylinder wall. This groove lines up with channel 39 which creates a flow path through check valve 40 and auxiliary port 38 that can be connected to chamber 37 depending on the position of piston 31. The check valve 40 acts as an auxiliary suction valve and prevents back flow from the cylinder. The valve would preferably be inertially balanced so that forces associated with piston acceleration do not force the valve to open or close at inappropriate times.

As with the first embodiment, linear motor 32 drives piston 31, which reciprocates in cylinder 33. Main suction valve 354 admits low-pressure suction gas to chamber, 37. The gas leaves the cylinder through discharge valve 35. An optional second auxiliary port 28 is located above the first port 38 and admits gas at an intermediate pressure above that of the first auxiliary port and below the discharge pressure. A controller 24 receives input from a piston-position sensor 26 controls the voltage to the linear motor 32.

The operation differs from the compressor in FIG. 1 in that the auxiliary suction gas comes into the cylinder at the beginning of the suction stroke before the main suction valve opens. This arrangement eliminates the expansion losses that occur in the first arrangement, but it does not give a compressor capacity improvement. While the drawing shows the auxiliary suction valve in the piston, it could also be located in the cylinder wall.

One option with this design is to use another port in the cylinder sidewall, and eliminate the main suction valve in the cylinder head. The additional port would be an axial groove that would be located below the first auxiliary port. Eliminating the main suction valve may reduce cost. An issue- is that it complicates the design of the piston suction valve, which would have to handle a much broader range of pressures.

Figure 3:
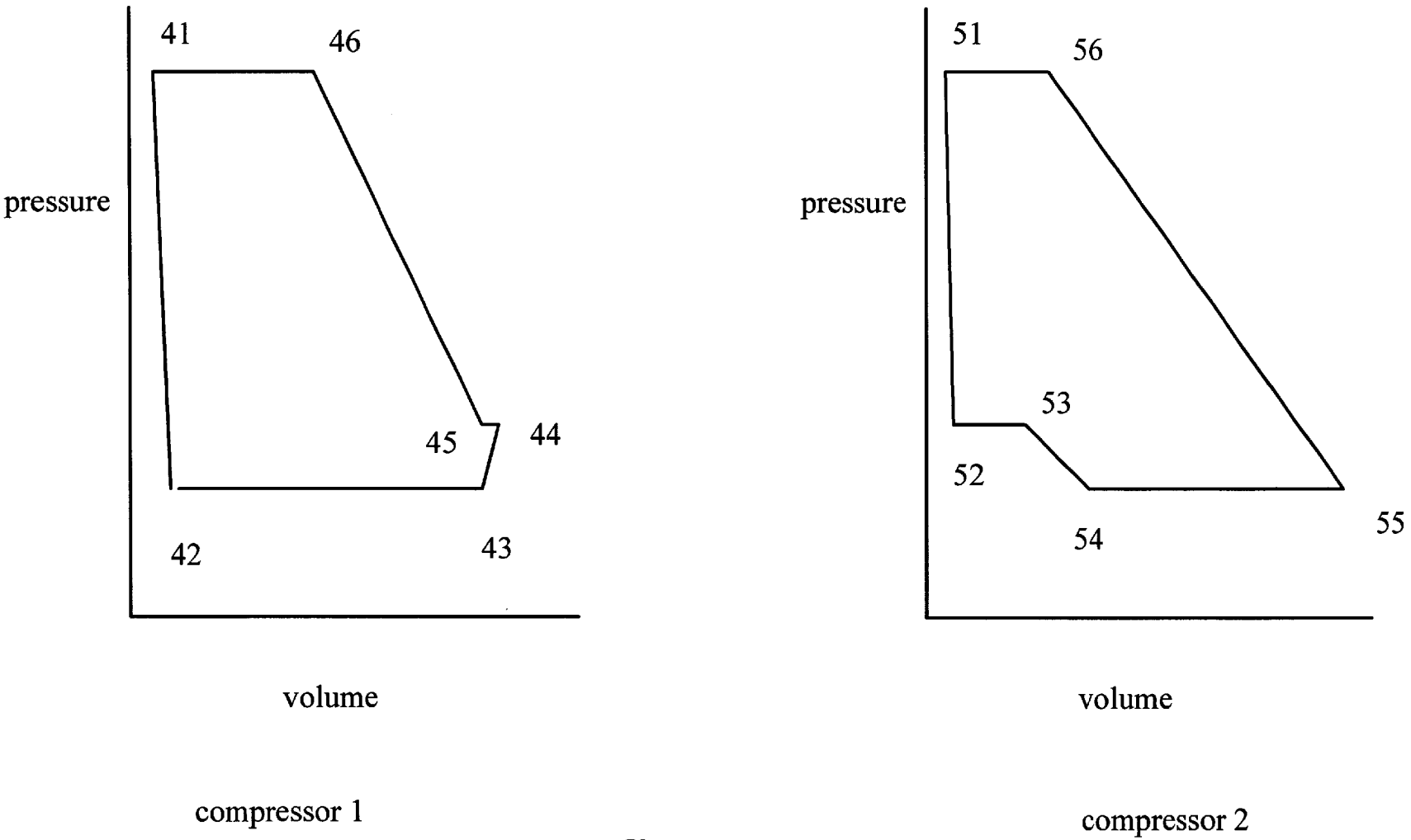
FIG. 3 shows schematic pressure-volume diagrams for these two compressor arrangements.

FIG. 3 is a pressure-volume diagram for the two arrangements with a signal auxiliary port. The table below describes the location of each point on the diagrams:

| point | compressor 1 | point | compressor 2 |
|---|---|---|---|
| 41 | top of piston stroke, discharge valve closes | 51 | top of piston stroke, discharge valve closes |
| 42 | main suction valve opens | 52 | auxilary suction valve opens |
| 43 | uncover auxiliary port, main suction valve closes | 53 | piston covers auxiliary port |
| 44 | bottom of piston stroke | 54 | main suction valve opens |
| 45 | piston covers auxiliary port | 55 | bottom of stroke, main suction valve closes |
| 46 | discharge valve opens | 56 | discharge valve opens |

Piston position gives a large range of control for both compressor configurations. For the compressor in FIG. 1, simply adjusting the stroke of the piston so that it does not uncover the auxiliary port effectively stops the flow of the higher-pressure suction gas. Increasing the clearance volume at the top of the stroke reduces the flow from the main suction port, but not the auxiliary port so long as the two suction pressures remain unchanged. This analysis shows that variations in piston stroke and average position can give a large variation in the flow from each suction port.

For the compressor in FIG. 2, piston position can give similar control. The difference is that the auxiliary suction port operates at the top of the piston stroke. A sufficiently large clearance volume prevents the piston from uncovering the auxiliary port or can keep the cylinder pressure higher than the auxiliary suction pressure when the piston does uncover the auxiliary port. These actions prevent flow through the auxiliary port, while allowing flow through the main suction valve. On the other hand, flow from the main suction valve can be stopped if the average piston position is higher in the cylinder. As the average piston position moves up it reaches the point where the cylinder pressure never drops below the main suction pressure, which stops the main suction flow. A combination of these two control modes can give a large range of flow from each port.

While these figures show systems with two suction pressures, any arbitrary number of pressures is possible. For the compressor in FIG. 1, the additional ports may be located on the cylinder walls in order of pressure with the lowest pressure closest to the top of the cylinder. The additional ports should have valves that allow gas to enter the cylinder during the intake stroke and close during the compression stroke.

For the compressor in FIG. 2, the approach to multiple auxiliary ports is similar except that the order is reversed. The highest-pressure suction gas should enter the cylinder first followed by the lower-pressure ports. Note that a single valve in the piston can accommodate multiple auxiliary ports. This arrangement will allow for a smooth transition between each pressure, which should give excellent efficiency.

Figure 4:
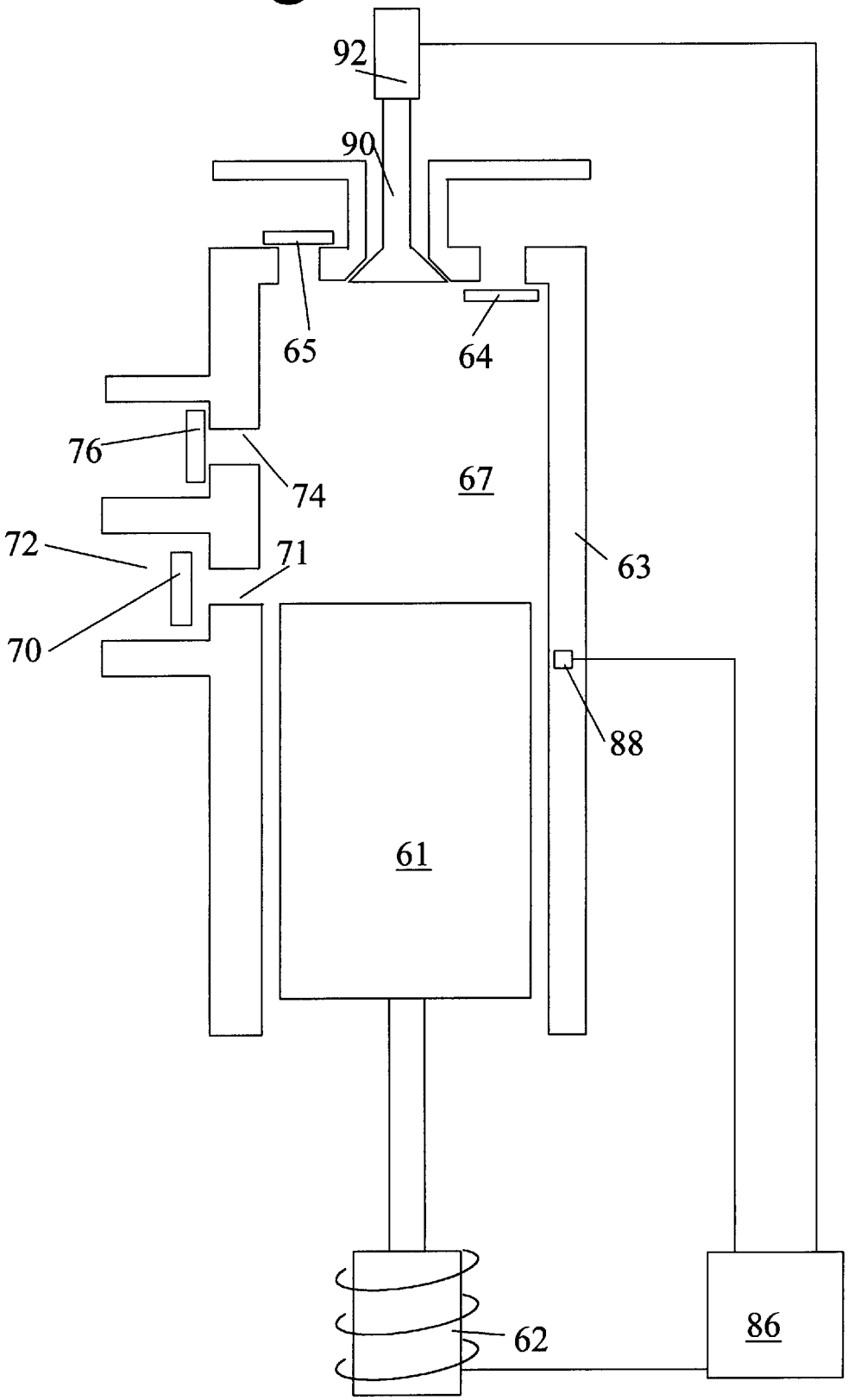
FIG. 4 is a third preferred embodiment that uses an auxiliary port and an auxiliary discharge valve to provide a second discharge pressure.

FIG. 4 is another porting setup that differs in that it creates an additional discharge port instead of a suction port. As with previous embodiments, suction valve 64 acts to admit fluid to chamber 67 which is defined by piston 61 and cylinder 63. The piston is preferably driven by linear motor 62, but a crank drive or other drive system is acceptable. A first auxiliary port 71 is connected to a check valve 70 that acts as an auxiliary discharge valve and can allow gas to flow from chamber 67 through flow path 72. During the up (compression) stroke the check valve 70 opens to allow fluid to escape at a pressure between suction and main discharge pressures. The piston then covers the port and further compresses the gas until the main discharge valve 65 opens. A controller 86 receives input from a piston-position sensor 88 and controls the voltage to the linear motor 62 to control piston position.

An optional second auxiliary port 74 and a check valve 76 are located in the cylinder wall above the first auxiliary port 71. They provide a second intermediate discharge pressure that is higher than that from the first auxiliary, port 71. Additional auxiliary ports may be added to allow extra discharge pressures, so long as the ports are ordered with the lowest pressure at the bottom of the stroke and the highest at the top. While the drawing shows the check valve 70 in the cylinder wall, it could also be located in the piston.

Control of the flow from each discharge port is similar to that for the suction ports. If the average piston position is high, it is possible to reduce or stop flow through the auxiliary port while still having flow through the main discharge valve. On the other hand, low average piston positions can keep low cylinder pressures that prevent the main discharge valve from opening, while still allowing flow through the auxiliary valve. Variation in the stroke length and clearance volume also affects the total flow. As with the suction ports, piston position can give a large range of control of the flows through the compressor.

These valving and porting arrangement use simple, low-cost, reliable, mechanical devices to provide the control. While not a preferred embodiment, it is also possible to achieve similar results using electrically, hydraulically, or pneumatically actuated valves to control gas flow through auxiliary suction or discharge ports. These actuated valves would preferably be in the cylinder head. FIG. 4 shows an optional valve 90 and valve actuator 92 located in the cylinder head. A piston position sensor and a control means would determine the proper timing for these valves. This setup would have the disadvantage of the higher cost and complexity associated with the actuators and controls, but it could achieve similar results and may offer slightly more flexible control.

These porting and valving arrangements can be combined to give a tremendous number of different options. For example a single compressor can combine the porting arrangements shown in FIGS. 1, 2, and 4. This flexibility means that the compressor can be customized to meet a wide range of different conditions.

While the usual fluid used in these compressors is a gas, the embodiments shown in FIGS. 2 and 4 can also pump liquids with similar advantage. These two embodiments differ from the first embodiment in that they do not depend on compressibility effects in order to function properly.

Overall these new compressor configurations offer a tremendous opportunity to improve efficiency and capacity of refrigeration and heat-pump systems. They also can give much more flexible temperature and capacity control. These advantages are possible using a single compressor, which greatly reduces the cost and complexity compared to systems with multiple compressors.

I claim:

1. A reciprocating compressor comprising:

a cylinder, a piston that reciprocates in said cylinder, a chamber defined by said piston and said cylinder, means for admitting fluid to said chamber, means for discharging fluid from said chamber, an auxiliary port, a flow path from said chamber through said auxiliary port, and means for blocking flow through said flow path through said auxiliary port during a portion of the piston stroke, and means for adjusting the timing of operation of said means for blocking flow during operation of said compressor, whereby said compressor moves a controllable flow of fluid through said auxiliary port; said auxiliary port comprises a sidewall port which can be blocked by said piston and said means for blocking flow comprises means for moving said piston over said auxiliary port and said means for adjusting timing of operation of said means for blocking flow comprises means for varying the piston stroke whereby the flow through said auxiliary port varies in response to changes in the portion of the stroke during which the piston blocks said auxiliary port.

2. The compressor of claim 1 wherein said means for varying piston stroke comprises a linear motor that is drivingly connected to said piston and means for varying voltage to said linear motor.

3. The compressor of claim 2 wherein said means for varying voltage to said linear motor further comprises a controller that is connected to said linear motor and a piston-position sensor which is also connected to said controller whereby said controller adjusts the voltage supplied to said linear motor to obtain the required piston stroke.

4. A reciprocating compressor comprising:

a cylinder, a piston that reciprocates in said cylinder, a chamber defined by said piston and said cylinder, means for admitting low-pressure fluid to said chamber, means for discharging high-pressure fluid from said chamber, a flow path extending from a side of the piston that slides over said cylinder through said piston to said chamber, an auxiliary port that supplies fluid at an intermediate pressure between that of said high-pressure fluid and that of said low-pressure fluid and is located in a wall of said cylinder so that said auxiliary port is intermittently connected to said chamber through said flow path through the piston during an upper portion of the piston stroke and is covered by said piston for a lower portion of the piston stroke, and a check valve that prevents flow away from said chamber and is located in series with said auxiliary port when the port is connected to said chamber so that, as the piston moves during its down stroke, the piston uncovers said auxiliary port to allow intermediate-pressure fluid to enter said chamber then the piston blocks said auxiliary port to stop the flow of intermediate-pressure fluid at which time the downward motion of the piston further lowers the pressure in said chamber and allows low-pressure fluid to enter the chamber through said means for admitting low-pressure fluid and when said piston then moves upward during its compression stroke, said check valve prevents flow of fluid away from said chamber through said auxiliary port.

5. The compressor claim 4 wherein said means for admitting fluid comprises a sidewall port that is connected to said flow path through said piston when said piston is near the bottom of its stroke.

6. The compressor of claim 4 wherein said means for admitting fluid comprises a suction valve located in a cylinder head at the top of said cylinder.

7. The compressor of claim 4 wherein said check valve is located in said piston.

8. The compressor of claim 7 further comprising at least a second auxiliary port wherein the auxiliary ports have different intermediate fluid pressures and the locations of the auxiliary ports in the cylinder wall are arranged so that each auxiliary port is sequentially connected to the flow path through said piston during a portion of the piston down stroke starting with the auxiliary port with the highest pressure and moving down to the auxiliary port with the lowest pressure so that fluid is sequentially admitted to said chamber from each auxiliary port.

9. The compressor of claim 4 wherein said check valve is located in a flow path upstream of said auxiliary port.

10. The compressor of claim 4 further comprising a linear motor that is drivingly connected to said piston.

11. A reciprocating compressor comprising:

a cylinder, a piston that reciprocates in said cylinder, a chamber defined by said piston and said cylinder, means for admitting low-pressure fluid to said chamber, means for discharging high-pressure fluid from said chamber, an auxiliary port that is located in the side wall of said cylinder at a position that allows the piston to cover the port when the piston is near the top of its stroke and uncover the port for a portion of the remainder of the stroke, and a flow control means for opening said auxiliary outlet in response to an intermediate internal pressure exceeding an external pressure, so that as the piston moves upward during its compression stroke, and fluid exits said chamber through said auxiliary port at an intermediate pressure that is between that of said high-pressure fluid and said low-pressure fluid until the piston covers said auxiliary port, wherein the upward motion of the piston further raises the pressure of said fluid to allow fluid to exit said cylinder through said means for discharging high-pressure fluid.

12. The compressor of claim 11 further comprising at least a second auxiliary port in the cylinder wall that is connected to a corresponding check valve that allows flow away from said chamber and the auxiliary ports discharge fluid at different intermediate pressures wherein the relative positions of the auxiliary ports in the cylinder wall are arranged so that as said piston moves upward during its compression stroke it covers the auxiliary ports in order of increasing supplied pressure, which allows fluid to exit sequentially from the chamber through each auxiliary port starting with the port with the lowest pressure and ending with the port with the highest pressure.

13. The compressor of claim 11, further comprising a linear motor that is drivingly connected to said piston.

* * * * *